US006026671A

United States Patent [19]

Battenfeld

[11] Patent Number: 6,026,671

[45] Date of Patent: Feb. 22, 2000

[54] PLIERS FOR CRIMPING WORKPIECES

[75] Inventor: Kurt Battenfeld, Ebsdorfergrund-Wittelsberg, Germany

[73] Assignee: Wezag GmbH Werkzeugfabrik, Stadtallendorf, Germany

[21] Appl. No.: 09/244,221

[22] Filed: Feb. 4, 1999

[30] Foreign Application Priority Data

Feb. 24, 1998 [DE] Germany ..... 198 07 737

[51] Int. Cl.[7] ..... H01R 3/042

[52] U.S. Cl. ..... 72/409.12; 72/409.01; 29/751; 81/313; 81/363

[58] Field of Search ..... 72/409.12, 409.09, 72/409.14, 409.01; 29/751; 81/126, 128, 129, 363, 362, 355, 313

[56] References Cited

U.S. PATENT DOCUMENTS

| | | | |
|---|---|---|---|
| 1,051,727 | 1/1913 | Gardner | 81/362 |
| 3,029,670 | 4/1962 | Over et al. | 81/15 |
| 3,903,725 | 9/1975 | Rommel | 72/409.09 |
| 5,385,072 | 1/1995 | Neff | 81/363 |
| 5,761,948 | 6/1998 | Malagnoux | 81/363 |
| 5,870,925 | 2/1999 | Morris | 81/313 |
| 5,913,933 | 6/1999 | Beetz | 72/409.12 |

FOREIGN PATENT DOCUMENTS

| | | | |
|---|---|---|---|
| 0 103 912 | 7/1983 | European Pat. Off. . | |
| 0 203 241 | 5/1985 | European Pat. Off. | 72/409.12 |
| 21 49 167 | 10/1971 | Germany . | |
| 296 19 451 U1 | 11/1996 | Germany . | |

*Primary Examiner*—Daniel C. Crane
*Attorney, Agent, or Firm*—Thomas, Kayden, Horstemeyer & Risley, L.L.P.

[57] ABSTRACT

Pliers (1) for crimping workpieces include a pliers head (2) including at least two cover plates (6, 7) and a recess (3), the cover plates (6, 7) having rectilinear channels arranged therein. A stationary crimping (4) die is arranged inside the recess (3) of the pliers head (2). A movable crimping die (5) is arranged inside the recess (3) of the pliers head (2). A guiding element (22) includes two spaced apart guiding projections (27, 28) and it defines a line of movement (33), the guiding element (22) including an opening (39) for its stroke (34), being connected to the movable crimping die (5) and linearly guiding the movable crimping die (5) in the rectilinear channels being arranged in the cover plates (6, 7). A bearing (37) is arranged at the cover plates (6, 7) and in the line of movement (33) between the two guiding projections (27, 28) of the guiding element (22) to enlarge the distance (24) between the two guiding projections (27, 28). The bearing (37) is fixedly arranged in the opening (39) of the guiding element (22). A toggle lever element (35) is supported on the bearing (37). A stationary handle (8, 9) is fixedly connected to the pliers head (2). A movable handle (10) is pivotable with respect to the pliers head (2) and it is connected to the guiding projection (27) adjacent to the crimping dies (4, 5) and to the toggle lever element (35). A toggle lever drive (36) to linearly move the movable crimping die (5) toward and away from the stationary crimping die (4) is provided.

13 Claims, 7 Drawing Sheets

PLIERS FOR CRIMPING WORKPIECES

CROSS REFERENCE TO RELATED APPLICATIONS

This application claims the benefit of co-pending German patent application number 198 07 737 entitled "Zange zum Verpressen von Werkstuecken", filed on Feb. 2, 1998.

FIELD OF THE INVENTION

The present invention generally relates to pliers for crimping workpieces. More particularly, the present invention relates to pliers for producing solderless crimping connections. The invention may also be applied to pliers for deforming workpieces. It goes without saying that most of the mentioned parts and elements, especially in case of an overall plate arrangement of the pliers, are provided twice in a double arrangement, although they are only mentioned once for reasons of clarity. This is especially true for the guiding elements and also for the toggle lever elements. One or both cover plates may be designed as uneven bodies.

BACKGROUND OF THE INVENTION

Pliers are known from German patent number 21 49 167. The pliers include a C-shaped pliers head having a plate arrangement with two plane cover plates. A stationary crimping die and a movable crimping die are arranged inside a circumferentially opened recess being located in the pliers head. The movable crimping die is linearly guided in an elongated slot being located in each of the cover plates by a guiding element. Two spaced apart guiding pins together with the elongated slot define a line of movement in which the stroke-like movement of the movable crimping die with respect to the pliers head occurs. A toggle lever drive is provided to linearly drive the movable crimping die. The toggle lever drive includes a handle being fixedly connected to the pliers head, a handle being pivotable with respect to the pliers head, the pivotable handle being pivotally connected to the guiding pin located in the guiding element facing the handles and to the toggle lever element, and a toggle lever element which is supported on a bearing being arranged at the cover plates in the line of movement. The guiding element and the toggle lever element are arranged one behind the other in the line of movement, so that the pliers head is comparatively long in this direction. The guiding pins are spaced apart from each other with a distance which is essential for the preciseness and for the tilt resistance of the linear guidance of the movable crimping die, and consequently for the quality of the crimped workpiece. The handles are made of metal and they are covered with handle-like coatings, the coatings covering a major portion of the handle extending from the pliers head. In the opened position of the pliers, the handles and the coatings, respectively, define the distance to be grabbed, meaning the distance to be grabbed at the beginning of the actuation of the pliers by the use of the thumb and the index finger. The ratio of transmission has to be considered since it has to be chosen great enough by realizing a specific construction to attain a great crimping force. The crimping dies of the pliers may include two alternatively usable nests which, for example, may have dimensions corresponding to workpieces of two different diameters.

Crimping pliers for crimping electrical conductors to corresponding connectors are known from U.S. Pat. No. 3,029,670. The pliers include a circumferentially opened recess being located in a C-shaped pliers head in which a first stationary crimping die is arranged, and in which a second crimping die is movably arranged. The movable crimping die is linearly guided in the pliers head by a cylinder-like guiding element. A toggle lever drive is provided for the stroke of the guiding element. The toggle lever drive is actuated by two handles, and it includes different additional levers. One of the levers of the toggle lever drive is supported in a stationary bearing. The disclosed pliers have a comparatively great overall length. The overall length of the pliers is determined by the need of room required for the linear guidance of the crimping die, and also by the arrangement of the toggle lever drive.

Other pliers for crimping workpieces are known from the European patent application number 0 203 241 A1. The pliers include a C-shaped pliers head, a stationary crimping die and a movable crimping die being arranged inside the pliers head. The movable crimping die is linearly guided inside the pliers head by a guiding element. The pliers head includes two longitudinal bores which are arranged symmetrically with respect to a longitudinal center plane. Two guiding projections being formed by a pin engage the two longitudinal bores. The pliers include a stationary handle and a pivotable handle. The pivotable handle is supported on the guiding projection facing the crimping dies. The guiding element has another longitudinal bore working together with a pin which is fixedly connected to the pliers head to form a linear guidance of the guiding element. The longitudinal bore determines the length of the possible stroke of the movable crimping dies and of the guiding element, respectively. The toggle lever drive is pivotally supported on the stationary pin by a toggle lever element. Thus, the stationary pin fulfils a guiding function for the guiding element as well as a supporting function for the toggle lever element of the toggle lever drive. The distance between these two guiding points depends on the angle of actuation of the handle. The pliers include only one nest being located at their crimping dies, so that tilt moments do not occur for the guiding element. The linearity of the guidance of the guiding element in the guiding point facing the crimping dies is only realized to a limited extend.

SUMMARY OF THE INVENTION

The present invention generally relates to pliers for crimping workpieces. More particularly, the present invention relates to pliers for crimping workpieces including a pliers head including at least two cover plates and a recess, the cover plates having rectilinear channels arranged therein. A stationary crimping die is arranged inside the recess of the pliers head. A movable crimping die is arranged inside the recess of the pliers head. A guiding element includes two spaced apart guiding projections and defines a line of movement, the guiding element including an opening for its stroke, being connected to the movable crimping die and linearly guiding the movable crimping die in the rectilinear channels arranged in the cover plates. A bearing is arranged on the cover plates and in the line of movement between the two guiding projections of the guiding element to enlarge the distance between the two guiding projections. The bearing is fixedly arranged in the opening of the guiding element. A toggle lever element is supported on the bearing. A stationary handle is fixedly connected to the pliers head. A movable handle is pivotable with respect to the pliers head and it is connected to the guiding projection adjacent to the crimping dies and it is connected to the toggle lever element. A toggle lever drive to linearly move the movable crimping die toward and away from the stationary crimping die is provided.

The present invention is based on the idea to replace the arrangement in series of the necessary guiding parts (projections and channels; pins and openings) and of the bearing of the toggle lever element by an overlapping arrangement in which the bearing of the toggle lever element is located between the guiding parts defining the linear guidance. Thus, an advantageously short overall length of the pliers results, which improves the handling of the pliers. On the other hand, the two guiding elements, which may be especially formed as guiding pins being guided in longitudinal slots, are spaced apart from each other by a relatively great distance, so that the tilt resistance of the linear guidance is advantageously increased without enlarging the entire length of the pliers in a disadvantageous manner. The guiding elements are enlarged, although the entire length of the pliers is short, and it is easily possible to realize a greater ratio of transmission at the toggle lever drive within the distance between the guiding pins, without having to enlarge the distance to be grabbed to an unacceptable extend. Thus, the pliers include an extremely long guidance at a short overall length. The distance between the guiding elements defining the linear guidance is approximately three times as great as in the pliers known in the prior art. A great tilt resistance of the linearly guided crimping die results from this enlarged support. It is also possible to bear greater tilt moments. This makes it possible to provide crimping dies including an increased number of nests, for example crimping dies being arranged in a perpendicular orientation to the line of movement. In this way, it is possible to realize three, four or even more nests at the crimping dies depending on the size of the nests and on the dies of the two crimping dies, respectively. Nevertheless, relatively small or short pliers being easy to handle result. The crimping quality which is attainable with the new pliers is improved, since the movable crimping die is guided more exactly with respect to the stationary crimping die located inside the pliers head. Consequently, the crimping operation is reproducible without departing from small tolerances. This has a positive effect on the working life of the pliers and of the crimping dies, respectively. The novel pliers also make it possible to enlarge the stroke of the movable crimping die without having to decrease the relatively great ratio of transmission. A distance to be grabbed which is acceptable for the user can be remained between the handles at an increased opening angle.

The pliers head and the handles may be designed and arranged to overlap in a longitudinal direction of the pliers. This means that the pliers head extends into the region of the handles, and that the handles extend into the region of the pliers head. This arrangement improves the tilt resistance by enlarging the distance between the guiding elements for the linear guidance. On the other hand, the entire length of the pliers is not enlarged, but it is additionally reduced. The distance to be grabbed may be designed to be smaller which makes it easier for the user to grab the pliers. The movable handle with its two bearings is arranged completely in the region of the pliers head.

The two handles may each include a plastic handle having two ends. The ends determine the distance to be grabbed and they extend beyond the bearing of the toggle lever element. The plastic handles include arches which project to the outside at their end facing the pliers head. The arches serve to support the thumb and the index finger of the user during the actuation of the closing movement of the pliers. The distance to be grabbed is hereby determined which makes it possible to chose the distance to be grabbed advantageously short. This is possible since the distance of the two bearings being located at the movable handle can be designed relatively short, although the opening angle of the movable handle with respect to the stationary handle is great. Thus, advantageous ratios of transmission of the toggle lever drive may be realized. It is even possible to advantageously enlarge the stroke of the movable crimping die. Generally, an enlarged stroke of the crimping die also enlarges the overall length of the pliers. Since the overall length of the pliers is reduced compared to the pliers known in the prior art, a portion of the reduced overall length can be used to enlarge the stroke of the movable crimping die. This makes it easier to replace the crimping dies, and it improves, for example, the handling of the pliers during an insertion of big workpieces between the opened crimping dies.

The opening being arranged in the guiding element may be designed to be circumferentially closed. Generally, it is possible to design the guiding element to be circumferentially opened. The length and the shape of the guiding element has to enable the stroke of the crimping die without it being hindered by the arrangement and by the design of the bearing for the toggle lever element. A circumferentially closed shape of the opening allows for a symmetric design of the guiding elements combined with a use of great supporting surfaces to prevent tilting. Thus, the guiding element may be designed and arranged to extend symmetrically with respect to the line of movement.

The toggle lever element may include a tooth portion of a locking mechanism and/or a support portion for an opening spring. The tooth portion of the locking mechanism is no longer arranged at the movable handle, but at the toggle lever element instead. Thus, the tooth portion is arranged with a greater distance to the turning point, and it allows for a more sensible design of the locking mechanism including a known locking latch. Additionally, the toggle lever elements may also include a support portion for the opening spring. The force of the opening spring is deviated in the opening direction by the bearing of the toggle lever element. The bearing connecting the toggle lever element to the movable handle is only brought into one end position during the closing action. This end position is located in front of the dead center, whereas the bearing of the toggle lever element and the guiding pin, on which the movable handle is supported, are located in the line of movement. Consequently, the opening action of the pliers being preferably effected by a compression opening spring is not hindered.

The guiding projections may be designed as guiding pins and the channels may be formed as elongated holes. The guiding pins may include supporting surfaces in the region of the elongated holes. The supporting surfaces are preferably plane surfaces being arranged at the generally circular pin. Preferably, the supporting surfaces are exclusively arranged in the region of the longitudinal slots of the cover plates. Consequently, the guiding pins preferably have a circular cross section in their other regions. One longitudinal slot is arranged in each of the cover plates for each of the two guiding pins. The two longitudinal slots being arranged in each of the two cover plates have the same length as it is necessary for the stroke of the movable crimping die. The width of the longitudinal slots corresponds to the distance between the two supporting surfaces arranged at the pins.

The plastic handles may each include an opening to support a portion of the pliers head. The plastic handle of the stationary handle covers a portion of the pliers head. The plastic handle of the movable handle moves over another portion of the pliers head in the closed position. This arrangement serves to realize the overlapping arrangement of the handle and the pliers head, and it makes it possible to especially attain the closed position of the handle and of the pliers, respectively, without reducing the usable length of the lever of the handle. Advantageously, the bearing for the support of the two toggle lever elements is aligned to the surface of the cover plates. This is especially true when the cover plate forms a common connected plate-like element together with the stationary handle, and when two such elements are used in the pliers in combination with only one movable handle.

The recess of the pliers head may be designed to be circumferentially opened. Two stiffening plates for the cover plates of the pliers head may be arranged between or outside of the cover plates. This arrangement is especially advantageous in case of a C-shaped design of the pliers head to prevent a deformation of the pliers head due to especially great crimping forces. The recess being arranged at the pliers head may also be designed to be circumferentially closed. In this case, there is no need to provide any stiffening plate. Also, in case of a mixed arrangement, meaning the arrangement of a circumferentially closed recess which can be opened, special stiffening plates are not required, and the thickness of the material of the cover plates can be further reduced.

It is therefore an object of the present invention to provide pliers including a movable crimping die having an improved tilt resistance.

Another object of the invention is to provide pliers having a short overall length.

Another object of the invention is to provide pliers having a great number of nests arranged in the crimping dies.

Another object of the invention is to provide pliers which make it possible to attain high-end quality crimping results.

Still another object of the present invention is to provide pliers having a relatively short overall length and including a movable crimping die having a relatively long stroke of.

Other objects, features and advantages of the present invention will become apparent to one with skill in the art upon examination of the following drawings and detailed description. It is intended that all such additional objects, features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION OF THE INVENTION

Figure 1:
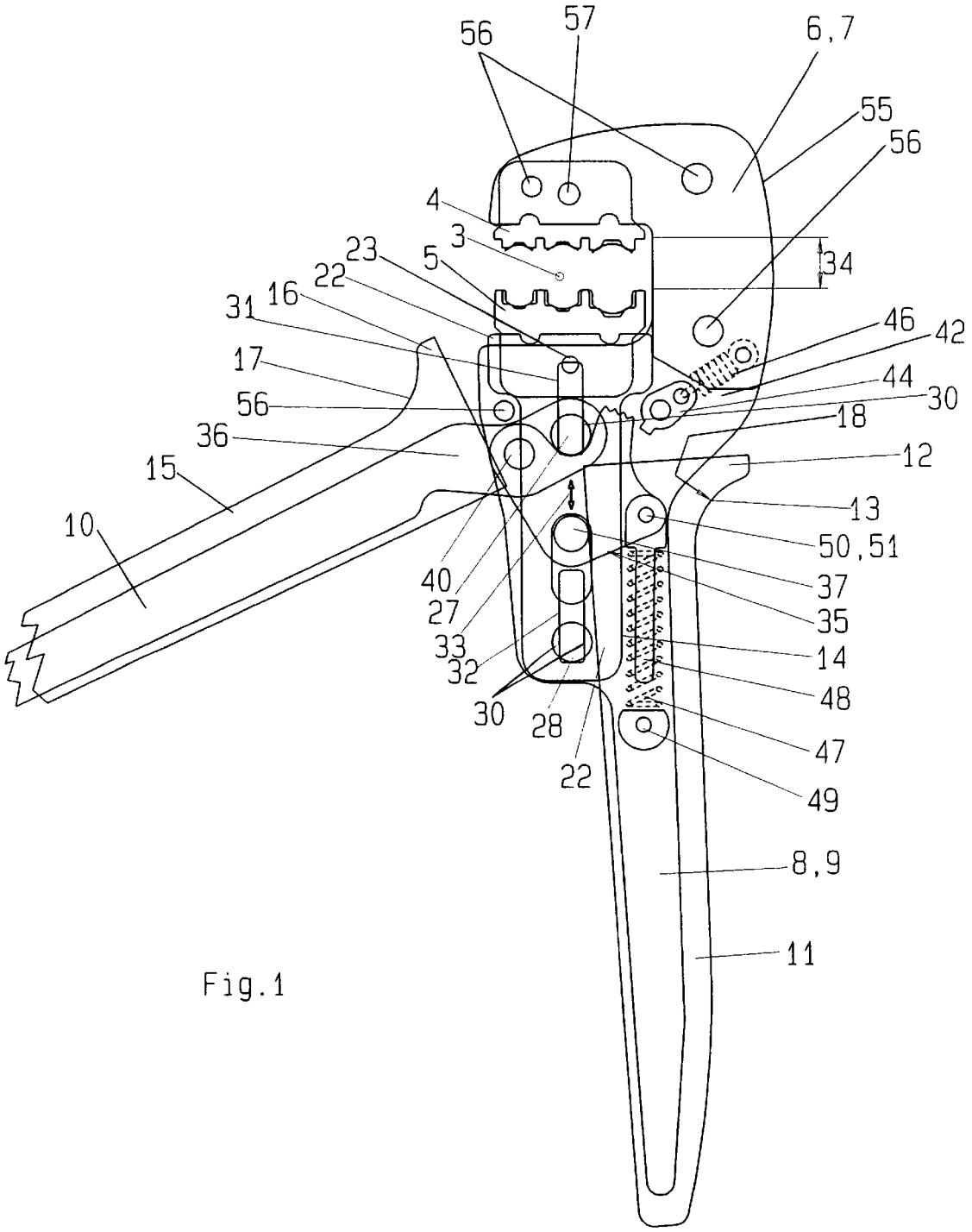
FIG. 1 illustrates a side view of a first embodiment of the pliers in their opened position.
Figure 2:
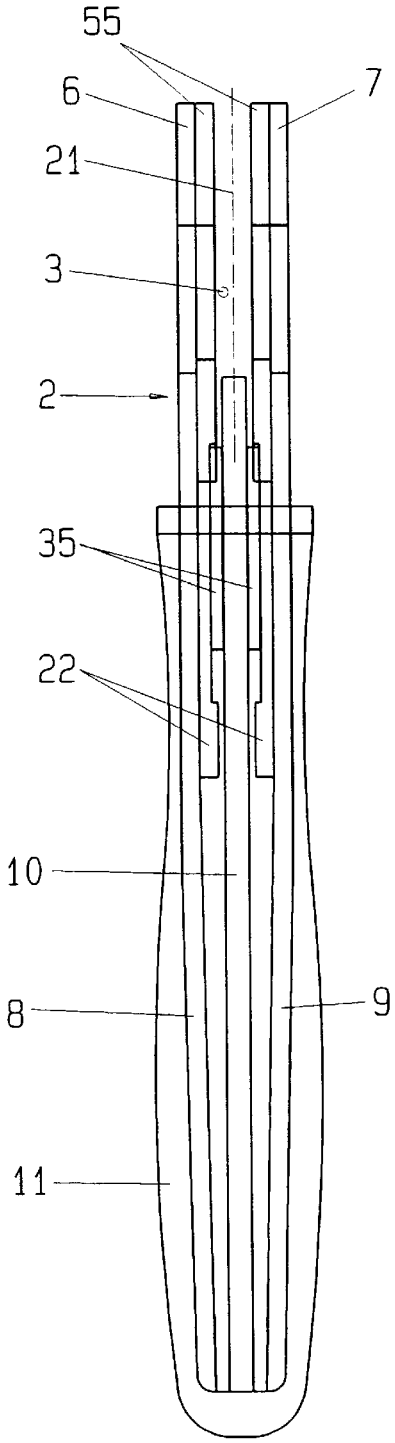
FIG. 2 illustrates a front view of the pliers of FIG. 1.
Figure 3:
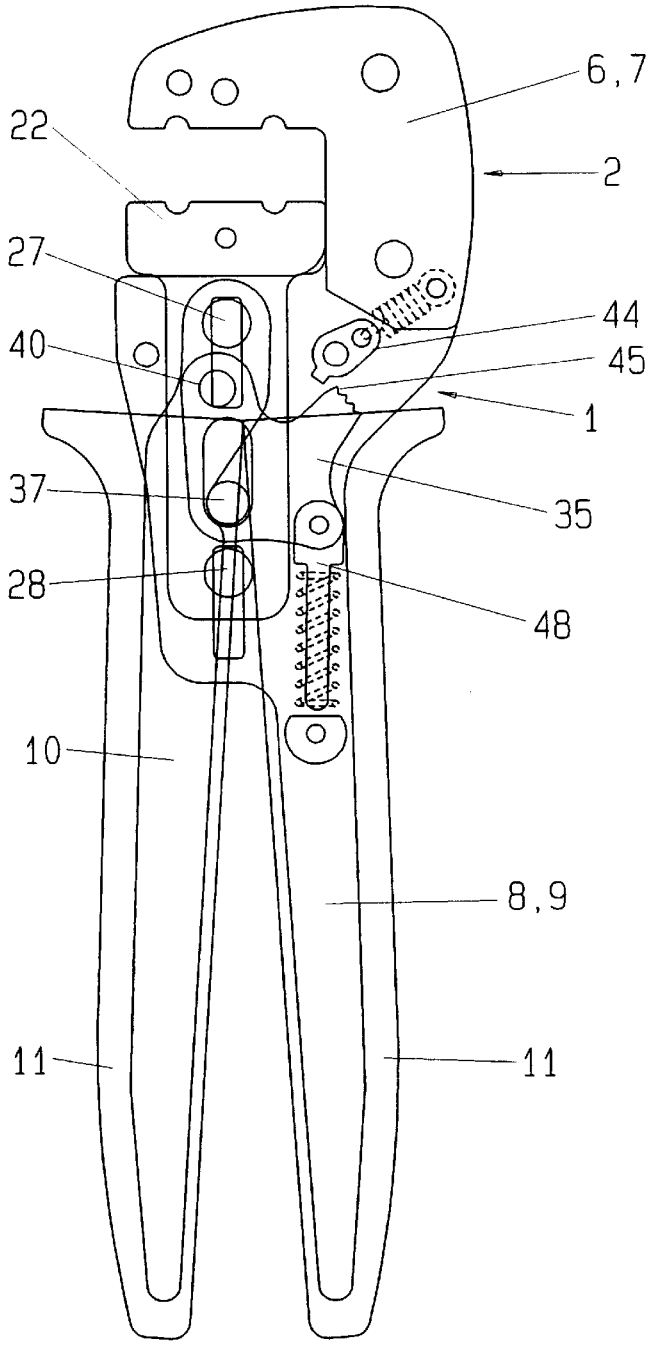
FIG. 3 illustrates a top view of the pliers of FIG. 1 in their closed position.

Referring now in greater detail to the drawings, the pliers 1 illustrated in FIGS. 1 to 3 have a C-shaped design. The pliers head 2 has a circumferentially opened recess 3 which is accessible from one side of the pliers head 2. The recess 3 makes it possible to insert and to replace, respectively, two crimping dies 4 and 5, and to insert and to replace a workpiece (not shown) to be crimped.

The pliers 1 are made of several plates. Consequently, all possible parts of the pliers 1 are designed as substantially plane plates which can be easily produced by machining, grinding or by punching. The shape of the parts is illustrated by continuous lines to improve the perceptibility, although the parts are arranged one behind another, and they therefore overlap with respect to one another.

Figure 4:
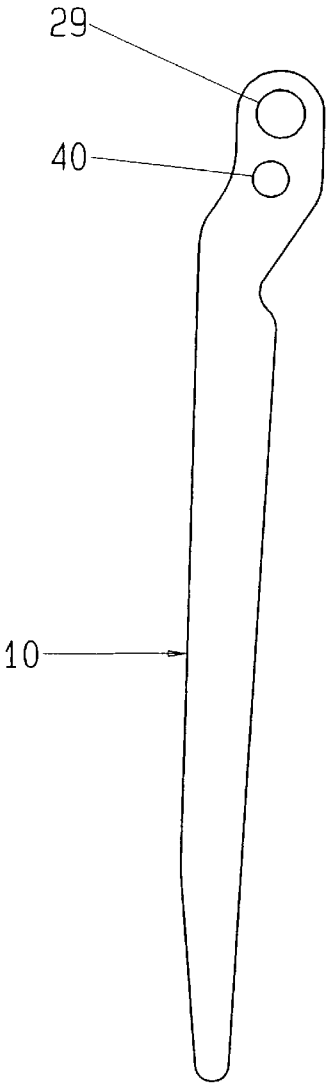
FIG. 4 illustrates a top view of the pivotable handle.
Figure 5:
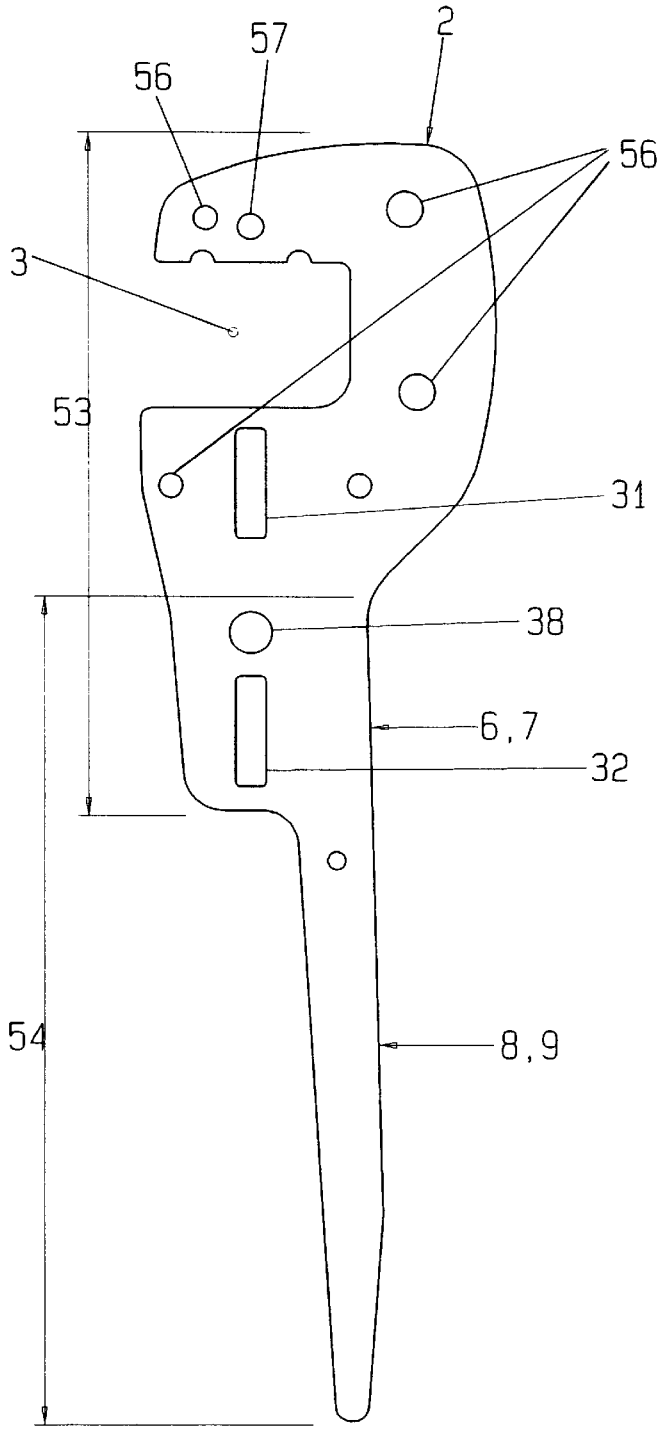
FIG. 5 illustrates a top view of the stationary handle including the cover plate.
Figure 6:
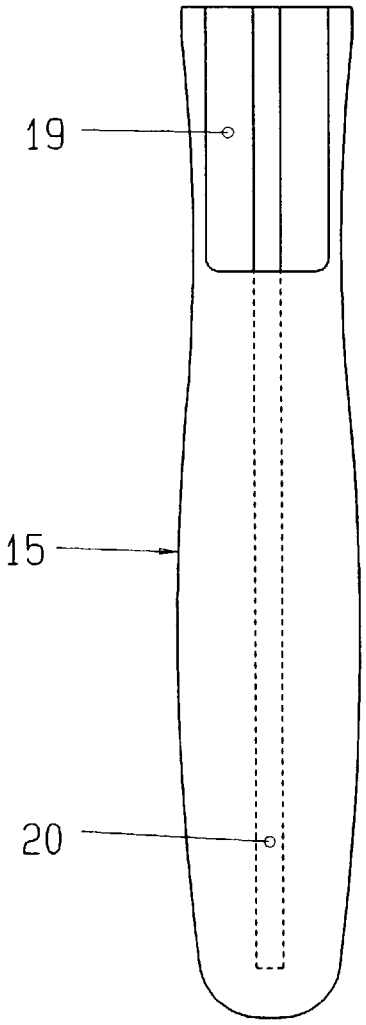
FIG. 6 illustrates an inside view of the plastic handle engaging the movable handle.
Figure 7:
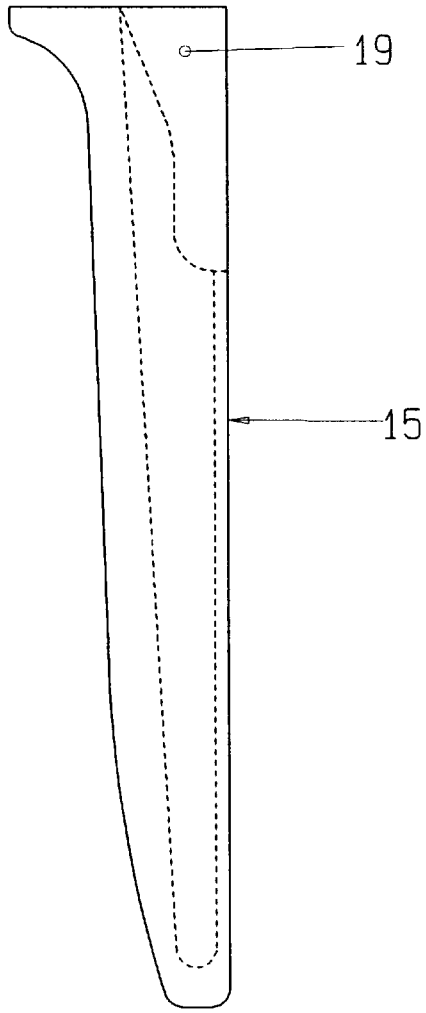
FIG. 7 illustrates a side view of the plastic handle of FIG. 6.

The pliers 1 include two cover plates 6 and 7 being C-shaped in the region of the pliers head 2, as it is especially illustrated in FIG. 5. The cover plates 6 and 7 extend beyond the pliers head 2 into stationary handles 8, 9. The cover plates 6, 7 and the corresponding stationary handles 8, 9 are made of one piece as substantially plane plates. It is also possible to produce these parts of two pieces, and to fixedly connect them to one another. The cover plates 6, 7 do not necessarily have to be made of plane plate material. It is also possible to apply the present invention to embodiments of the pliers 1 which are not made of plane materials. One single pivotable handle 10 is allocated to the two stationary handles 8 and 9 being provided twice in the pliers 1, as well as the cover plates 6, 7. The pivotable handle 10 has the shape which is especially illustrated in FIG. 4. The handle 10 is also made of a plane plate. A plastic handle 11 is allocated to the two stationary handles 8 and 9. The end 12 of the plastic handle 11 facing the pliers head 2 has an arch 13 extending to the outside of the pliers head 2. The plastic handle 11 projects into the pliers head 2 to a great extent, and consequently, it supports a great portion 14 of the pliers head 2. A plastic handle 15 is provided to support the handle 10 being made of metal. The plastic handle 15 is illustrated in FIGS. 6 and 7 in two different views. The plastic handle 15 also has an arch 17 at its end 16 facing the pliers head 2. The arch 17 also extends to the outside of the pliers head 2. The distance between the arches 13 and 17 defines the distance 18 to be grabbed. The distance 18 to be grabbed is the distance that has to be covered by the user's thumb and index finger of one hand, when the user holds the pliers 1 in their opened position illustrated in FIG. 1.

As it is especially illustrated in FIGS. 6 and 7, the plastic handle 15 to be mounted on the movable handle 10 has a recess 19 located in its portion facing the pliers head 2. The recess 19 is designed to be open to the front and to the rear of the handle 10, meaning between the plastic handles 11 and 15. As illustrated in FIG. 3, consequently, the recess 19 engages the left portion of the portion 14 of the pliers head 2 in the closed position. Furthermore, the plastic handle 15 includes an elongated slot 20 being located in its middle portion. The dimensions and the arrangement of the elongated slot 20 corresponds to the shape of the handle 10. The plastic handle 11 has a similar design which is not illustrated in greater detail. The plastic handle 11 also has a recess which is formed to engage the right region of the portion 14 of the pliers head 2 in the closed position. Its elongated slot is designed to be wider, and it corresponds to the stationary handles 8 and 9 which are arranged inside the pliers 1 with the distance illustrated in FIG. 2.

Figure 8:
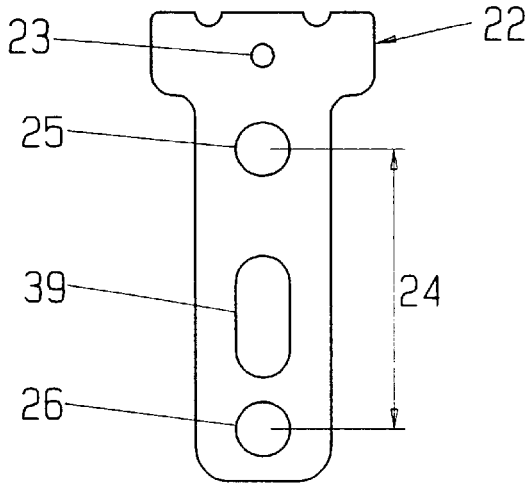
FIG. 8 illustrates a top view of the guiding element.

Another essential element of the pliers 1 is a guiding element 22. The guiding element 22 is arranged in a double arrangement with respect to a longitudinal center plane 21. The guiding element 22 is illustrated in greater detail in FIG. 8. The guiding element 22 extends beyond the outline of the cover plates 6 and 7, and into the recess 3 to a certain extend. At that point, the guiding element 22 carries the movable crimping die 5. This is true for the upper portion of the guiding element 22 in the opened position of the pliers 1, as well as in the closed position of the pliers 1. The guiding element 22 includes a bore 23, into which a screw is inserted (not shown) to fixedly attach the movable crimping die 5 to the guiding element 22. The guiding element 22 further includes two bores 25 and 26 which are spaced apart from each other with a distance 24. The bores 25 and 26 serve to support guiding pins 27 and 28. The guiding pins 27 and 28 are substantially formed as pins having a circular cross section. The guiding pins 27 and 28 are designed and arranged symmetrically to the longitudinal center plane 21. They extend through a bore 29 from the inside to the outside, into the movable handle 10, into both guiding elements 27 and into both cover plates 6 and 7. The guiding pins 27 and 28 have plane supporting surfaces 30 in the region of the cover plates 6, 7. The supporting surfaces 30 are guided in longitudinal slots 31 and 32 in the region of the cover plates 6, 7 of the pliers head 2. The distance 24 between the guiding pins 27, 28, and consequently the arrangement of the supporting surfaces 30 with respect to one another determines the tilt resistance of the supports or bearings of both guiding elements 22. Additionally, a line of movement 33 is determined which is illustrated by a double arrow in FIG. 1. The line of movement 33 represents the linear movability of the guiding elements 22 and finally of the linearly movable crimping die 5. The guiding pin 27 facing the pliers head 2 extends through the bore 29 of the pivotable handle 10, as well as through the two bores 25 being located in the guiding elements 22, as well as through the elongated slot 31 arranged in the cover plates 6 and 7, the supporting surfaces 30 of the guiding pin 27 being supported in the elongated slot 31. The guiding pin 28 being arranged inside the pliers head 2 facing the handles 8 and 9 only extends through the bores 26 being located at the guiding elements 22. The supporting surfaces 30 of the guiding pin 28 are supported in the elongated slots 32 being arranged in the cover plates 6 and 7. The elongated slots 31 and 32 each have a length which at least corresponds to the stroke 34 which is traveled by the linearly movable crimping die 5 with respect to the stationary crimping die 4 between the opened position and the closed position of the pliers 1.

Figure 9:
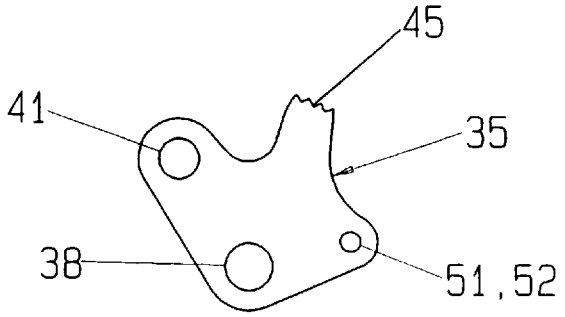
FIG. 9 illustrates a top view of the toggle lever element.

A toggle lever drive 36 is formed by a toggle lever element 35 (illustrated in greater detail in FIG. 9), which is provided at the pliers 1 in a double arrangement, in combination with the pivotable handle 10. Both toggle lever elements 35 are pivotally supported in a bearing 37 being arranged in a stationary manner in the pliers head 2 with respect to the cover plates 6 and 7. The bearing 37 includes a pin extending through the aligned bores 38 being located in the cover plates 6, 7, and through an elongated opening 39 being located in each of the two guiding elements 22. The length of the opening 39 is chosen and arranged considering the stroke 34, so that both guiding elements 22 may extend beyond the bearing 37 without impeding the linear movability by the stationary bearing 37. The pin of the bearing 37 extends through the opening 39 with a clearance, i.e. there is no guidance for the guiding elements 22 at this point. The opening 39 being located at the guiding elements 22 could also be designed to be circumferentially opened. By the arrangement of the bearing 37 between the two guiding pins 27 and 28, the distance 24 having a great influence on the tilt resistance of the movable crimping die 5 is enlarged without the overall length of the pliers 1 being enlarged (in its main direction of extension) by the arrangement of the bearing 37. Consequently, the maximum attainable quality of the workpieces to be crimped is improved. The toggle lever drive 36 is completed by the pivotable handle 10 being mounted to the toggle lever element 35. For this purpose, the pivotable handle 10 includes a bore 40, and the toggle lever element 35 includes a bore 41 through which a pin (not shown) projects, so that a pivotable link is provided. The ratio of transmission of the toggle lever drive 36 is determined by the ratio of the distance between the two bores 38 and 41 being located at the toggle lever elements 35 with respect to the distance between the two bores 29 and 40 being located at the pivotable handle 10. As illustrated in FIG. 3, the toggle lever drive 36 is only used right before the dead center is reached. This means that the center of the bore 40 and of the pin extending through the bore 40, respectively, is located a little bit to the left of the line of movement 33. Consequently, it is rather easy to open the pliers 1 after the closed position has been reached. On the other hand, the necessary crimping force can be transmitted at all times.

A locking mechanism 42 is provided to reproducibly reach an end position of the crimping dies 4 and 5 travelling along the entire stroke 34, and consequently to attain a guaranteed crimping force. The locking mechanism 42 includes a locking latch 44 being pivotally arranged on a pin 42. The locking latch 44 engages a tooth portion 45 being arranged at the toggle lever element 35. A pivot spring 46 is arranged between the cover plates 6, 7 and the locking latch 44. The pivot spring 46 leads the locking latch 44 back into the neutral position illustrated in FIG. 1, when the locking latch 44 is free from the tooth portion 45.

An opening spring 47 in form of a compression spring is supported on a pin-like spring block 48 to prevent deformation of the opening spring 47 and to open the pliers 1 from the closed position according to FIG. 3 into the opened position according to FIG. 1. The spring block 48 extends through a substantial portion of the length of the opening spring 47. The other end of the opening spring 47 is supported on a stationary bearing 49 being arranged between the stationary handles 8 and 9. The spring block 48 with a pivot pin 50 is pivotally connected to the two toggle lever elements 35. The pivot pin 50 extends through bores 51 being arranged in the toggle lever elements 35. The pivot pin 50 and the bores 51 form a connecting point 52 for the connection of the opening spring 47 and the toggle lever elements 35. The force of the opening spring 47 effects the opening action of the toggle lever drive 36 after the closed position has been reached and after the handles 8, 9 and 10 are free from forces applied by the hand of the user.

Figure 10:
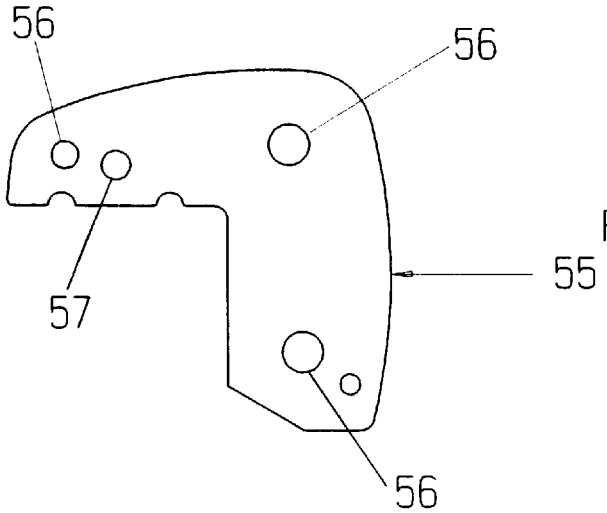
FIG. 10 illustrates a top view of the stiffening plate.

As illustrated in FIG. 5, the cover plates 6 and 7 of the pliers head 2 have a length 53 in the main direction of extension of the pliers 1. The length 53 is greater than in the prior art. The handles 8, 9, 10 have a length 54 which is not shorter compared to the prior art to apply great crimping forces by the correspondingly long levers of the handles 8, 9 and 10. It can be seen from FIG. 5 how the lengths 53 and 54 of the cover plates 6, 7, on the one hand, and of the handles 8, 9 and 10, on the other hand, overlap. By this arrangement, a relatively short entire length of the pliers 1 in their main direction of extension is attained, although the elongated slot known from the prior art has been divided into the two novel elongated slots 31 and 32 having a greater distance 24 between each other, and therefore improving the tilt resistance of the movable crimping die 5. This arrangement makes it possible to increase the maximum number of nests to be arranged at the crimping dies 4 and 5. For example, FIG. 1 illustrates three alternatively usable nests being located at the crimping dies 4, 5. The number of nests can be further increased. It is possible that some of the nests extend laterally outside the recess 3, and beyond the outline of the cover plates 6, 7. Such an arrangement is possible due to the improved tilt resistance of the movable crimping die 5, although great tilt forces occur at the crimping dies 4, 5 during the use of such a nest being located with a relatively great distance to the line of movement 33. The entire or overall length of the pliers 1 is not increased by arranging the stationary bearing 37 between the two guiding pins 27 and 28. Instead, the enlarged distance 24 is used for the arrangement of the bearing 37 in a special way. Realizing the pliers 1 in C-shape, as illustrated in FIGS. 1 to 5, enormous crimping forces can be attained, since relatively great lengths of the lever of the toggle lever drive 36 are arrangeable corresponding to the distance 24. In case of such great crimping forces, the pliers 1 may deform in the region of the C-shaped cover plates 6, 7. To prevent such a deformation and to improve the stiffness of the pliers 1, two stiffening plates 55 (FIG. 10) may be arranged below the cover plates 6 and 7 in a region of the pliers head 2 (FIG. 2).

The two cover plates 6, 7 are spaced apart and they are connected to one another at several points in the region of the pliers head 2. For this purpose, several supporting points 56 being realized by pins and screws (not illustrated), respectively, are provided. The cover plates 6, 7 and the stiffening plates 55 include bores 57 which serve to fixedly support the stationary crimping die 4, and through which a locking screw (not illustrated) projects. The stationary crimping die 4 is supported on the cover plates 6, 7 and on the stiffening plates 55, respectively. The movable crimping die 5 is supported on the two guiding elements 22.

Figure 11:
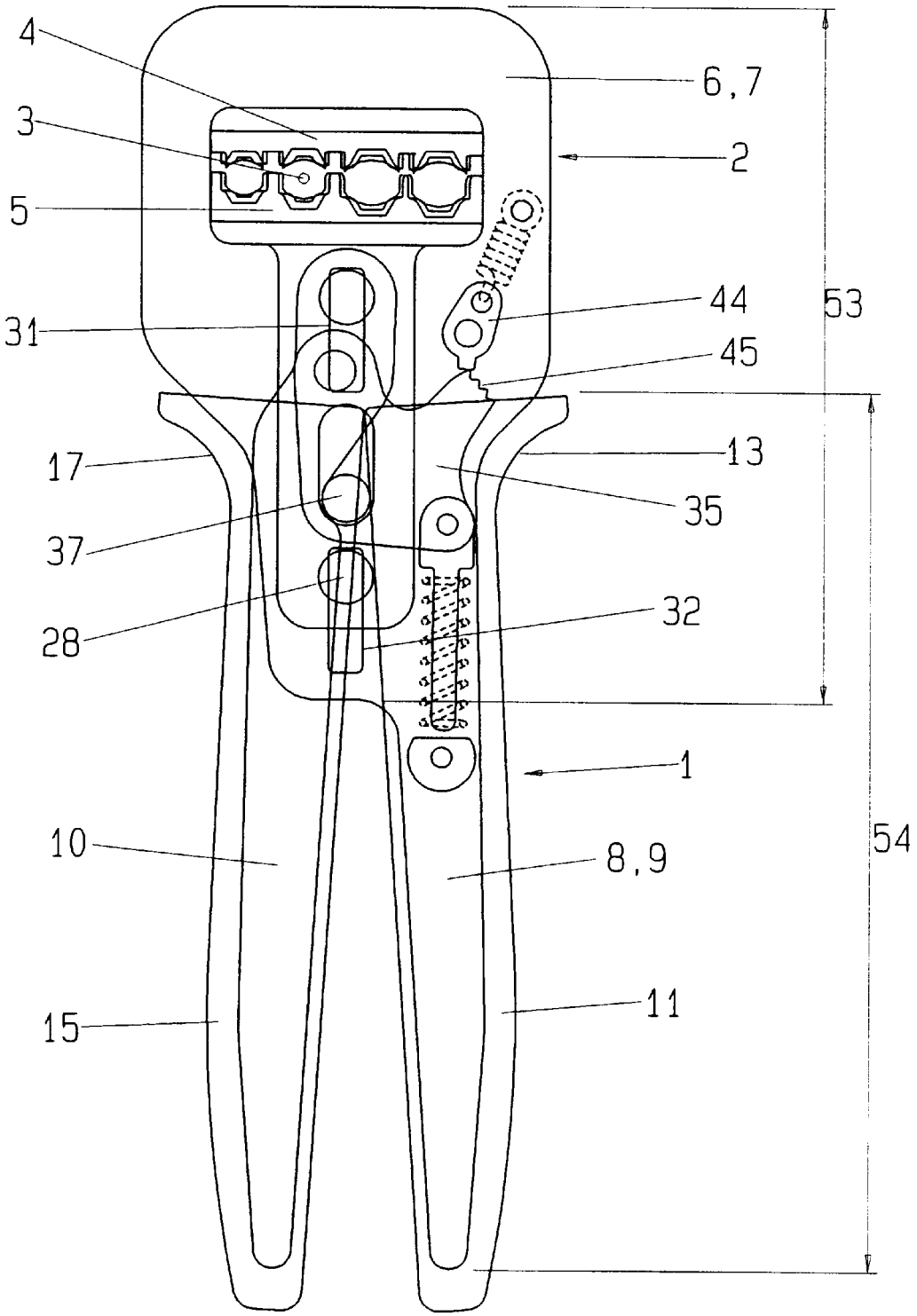
FIG. 11 illustrates a side view of the pliers having a circumferentially closed pliers head in its closing position.
Figure 12:
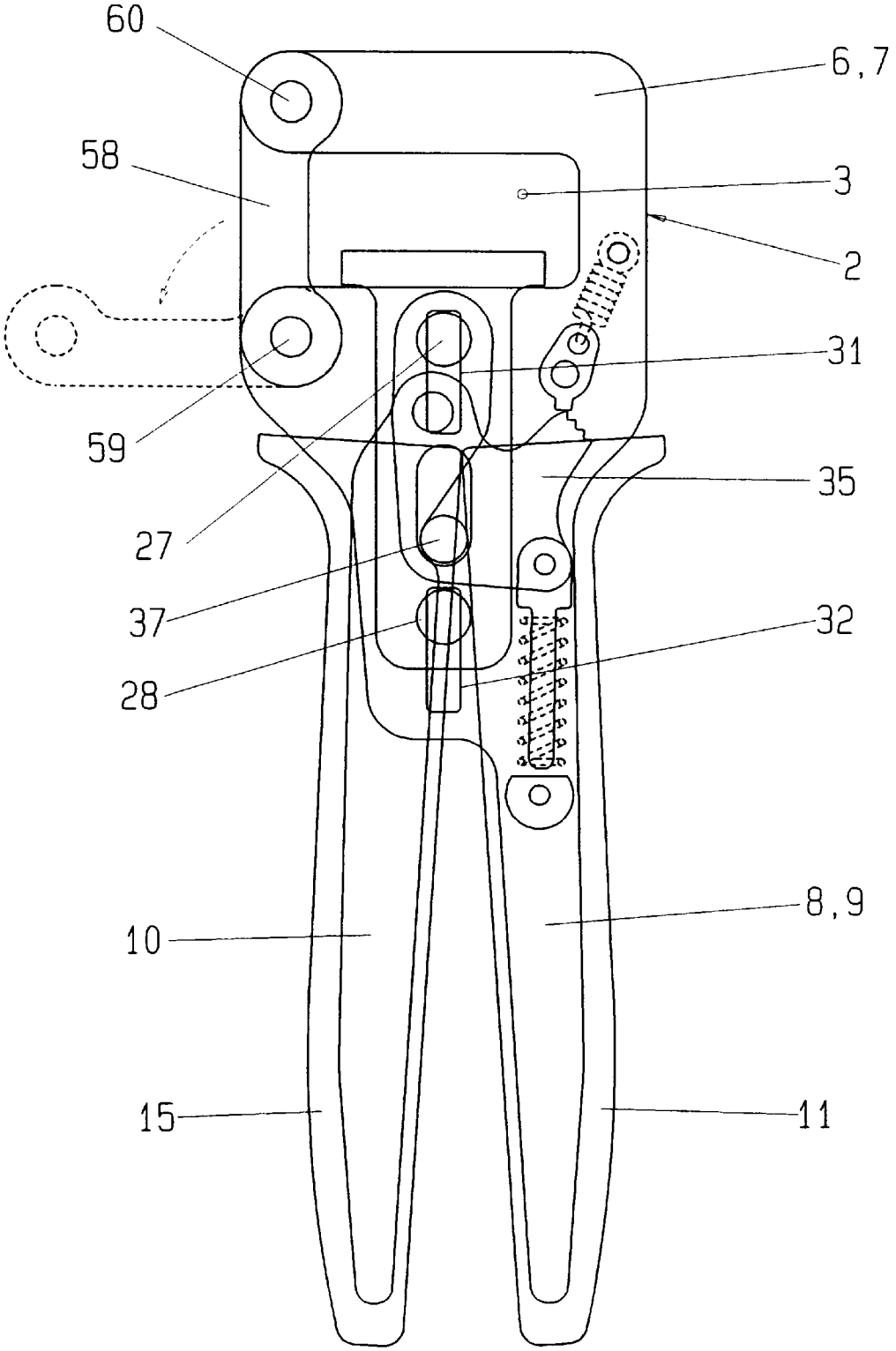
FIG. 12 illustrates a top view of another embodiment of the pliers in their closing position.

Two different embodiments of the pliers 1 are illustrated in FIGS. 11 and 12. FIG. 11 illustrates a closed pliers head 2. This is called an A-form in which the two cover plates 6 and 7 have a circumferentially closed recess 3, so that the workpiece to be crimped is not inserted laterally into the recess 3 of the pliers head 2 and into the alternatively usable nests being located between the crimping dies 4 and 5, but only in a longitudinal direction exzending perpendicularly to the plane of projection of FIG. 1. Correspondingly, the workpiece is replaced after the crimping action has been finished. All other elements and parts are designed and arranged correspondingly or similarly to the above described C-shaped embodiment. The two stiffening plates 55 do not have to be provided, since the force support is improved by the closed shape of the pliers head 2, and a deformation is prevented.

FIG. 12 illustrates a mixed embodiment. A circumferentially closed recess 3 is arranged in the pliers head 2, the crimping dies 4 and 5 not being illustrated. Additionally to the cover plates 6, 7, a pivot element 58 is arranged which is pivotable about a bearing 59 in the illustrated manner. The upwardly pivoted position is illustrated by a dashed line in FIG. 12. The recess 3 is designed to be laterally opened to make it possible to laterally insert the workpiece to be crimped, and to make it easier to replace the crimping dies 4 and 5. The pivot element 58 is pivoted into its closed position as illustrated by the continuous lines. In this position, the pivot element 58 is secured by a pin 60, or it is supported on the cover plates 6, 7 in another way.

Many variations and modifications may be made to the preferred embodiments of the invention without departing substantially from the spirit and principles of the invention. All such modifications and variations are intended to be included herein within the scope of the present invention, as defined by the following claims.

I claim:

1. Pliers for crimping workpieces comprising:

a pliers head including at least two cover plates and a recess, said cover plates having rectilinear channels arranged therein;

a stationary crimping die being arranged inside said recess of said pliers head;

a movable crimping die being arranged inside said recess of said pliers head;

a guiding element including two spaced apart guiding projections and defining a line of movement, said guiding element including an opening for its stroke, being connected to said movable crimping die and linearly guiding said movable crimping die along said rectilinear channels being arranged in said cover plates;

a bearing being arranged at said cover plates and in the line of movement between said two guiding projections of said guiding element to enlarge the distance between said two guiding projections, said bearing being fixedly arranged inside said opening of said guiding element;

a toggle lever element being supported on said bearing;

a stationary handle being fixedly connected to said pliers head;

a movable handle being pivotable with respect to said pliers head and being connected to said guiding projection adjacent to said crimping dies and to said toggle lever element; and a toggle lever drive to linearly move said movable crimping die toward and away from said stationary crimping die.

2. The pliers of claim 1, wherein said pliers head and said handles are designed and arranged to overlap in a longitudinal direction of said pliers.

3. The pliers of claim 2, wherein said two handles each include a plastic handle having two ends, said ends determining the distance to be grabbed and extending beyond said bearing of said toggle lever element.

4. The pliers of claim 1, wherein said opening of said guiding element is designed to be circumferentially closed.

5. The pliers of claim 4, wherein said guiding element is designed to extend symmetrically to said line of movement.

6. The pliers of claim 1, wherein said toggle lever element includes a tooth portion of a locking mechanism.

7. The pliers of claim 1, wherein said toggle lever element includes a support portion for an opening spring.

8. The pliers of claim 1, wherein said toggle lever element includes a tooth portion of a locking mechanism and a support portion for an opening spring.

9. The pliers of claim 1, wherein said guiding projections are designed as guiding pins and said channels are formed as elongated holes, and wherein said guiding pins include supporting surfaces in the region of said elongated holes.

10. The pliers of claim 9, wherein one elongated hole is provided in each of said cover plates for each of said guiding pins.

11. The pliers of claim 3, wherein each of said plastic handles includes an opening to support a portion of said pliers head.

12. The pliers of claim 1, wherein said recess of said pliers head is designed to be circumferentially opened, and wherein two stiffening plates are provided for said cover plates.

13. The pliers of claim 1, wherein said recess of said pliers head is designed to be circumferentially closed.

* * * * *